US005853084A

United States Patent [19]

Carter et al.

[11] Patent Number: 5,853,084

[45] Date of Patent: Dec. 29, 1998

[54] PLUNGER MECHANISM

[75] Inventors: Richard John Carter; Roger Louis Hambidge, both of Cheltenham, England

[73] Assignee: Delta Schoeller Limited, England

[21] Appl. No.: 844,792

[22] Filed: Apr. 22, 1997

[30] Foreign Application Priority Data

Apr. 22, 1996 [GB] United Kingdom ..... 9608282

[51] Int. Cl.[6] ..... H01H 13/70

[52] U.S. Cl. ..... 200/345; 200/341; 200/318.2

[58] Field of Search ..... 200/345, 61.44, 200/295, 296, 293, 318.2, 327, 341, 331

[56] References Cited

U.S. PATENT DOCUMENTS

| | | | |
|---|---|---|---|
| 4,227,060 | 10/1980 | Ayres et al. | 200/296 |
| 5,154,282 | 10/1992 | Pascal | 200/345 |
| 5,389,756 | 2/1995 | Micallef | 200/345 |
| 5,512,717 | 4/1996 | Magome et al. | 200/345 |

FOREIGN PATENT DOCUMENTS 2084803 4/1982 United Kingdom .

*Primary Examiner*—David J. Walczak

[57] ABSTRACT

A plunger mechanism is disclosed comprising: a plunger slidable in a generally cylindrical body between an extended position and a retracted position. A bush receives the body for relative rotation about the axis. The body and the bush are formed with co-operating means allowing the body to slide axially when the body is in one rotational position relative to the bush and to be locked axially when the body is in another rotational position relative to the bush. A stop member is slidable in the body and biassed in one direction. The stop member is formed with a lug projecting through a slot in the body and into a slot in the bush. The plunger is provided with means for engaging the stop member to slide it in the body against the bias. The slots in the body and in the bush each have a narrow section in which the lug locates when the stop member is in a first position in the direction in which it is biassed. The narrow section maintains the body in said one rotational position relative to the bush and prevents relative rotation of body relative to the bush. One or both of the slots in the body and the bush have a wider section in which the lug locates when the stop member is in a second position in a direction against the bias. The wider section allows relative rotation of the body relative to the bush, from said one position to said other rotational position.

4 Claims, 6 Drawing Sheets

PLUNGER MECHANISM

This invention relates generally to plunger mechanisms.

The background to the invention will be described in relation to a problem which occurs in a particular application of plunger mechanisms, that of electrical switches, more particularly stoplamp switches for road vehicles.

A vehicle's stoplamp switch is operated by a a plunger biassed in a direction outwardly from a body. In an extended position of the plunger switch contacts complete a circuit to switch on the stop lights. The switch is installed in such a position relative to the vehicle's brake pedal, that when the brake is not operated and the pedal returns to the end of its travel, a part of the pedal contacts and depresses the plunger into the housing breaking the circuit.

When the switch is installed it is necessary to position it axially so that the plunger is depressed suitably when the pedal is at the end of its travel. A known stoplamp switch has a mechanism for simplifying the installation of the switch. A bush is received in a bracket over the brake pedal. The bush and the body of the switch are formed with co-operating means allowing the body to slide axially when the body is in one rotational position relative to the bush and to be locked axially when the body is in another rotational position relative to the bush. The cooperating means are exemplified by a coarse screw thread inside the bush and on the body. Longitudinal grooves in both screw threads allow the body to slide in the bush when the body is located in one rotational position relative to the bush. The body may be rotated from that relative position to bring the screw threads into engagement at what ever axial position the body is in.

To install the switch the bush is first assembled in a suitable hole in the bracket. The body is inserted in the bush until the plunger is depressed by the brake pedal. The body is then twisted to engage the screw threads and detents hold that body in that position. The detents are also arranged to ensure that from the position in which it is slidable in the bush, the body can only be rotated in a direction in which the screw thread moves the body in a direction away from the brake pedal. This ensures that contact between the pedal and the plunger is always controlled by the bias of the plunger.

A potential problem which has been recently recognised is that if when installing the switch, if it is twisted in the bush before the plunger is sufficiently depressed by the brake pedal, the switch will not function properly and may leave the stoplamp permanently on.

Against this background, in accordance with the invention, there is provided a plunger mechanism, comprising: a plunger slidable in a generally cylindrical body between an extended position and a retracted position; and a bush for receiving the body for relative rotation about the axis, the body and the bush being formed with co-operating means allowing the body to slide axially when the body is in one rotational position relative to the bush and to be locked axially when the body is in another rotational position relative to the bush; a stop member slidable in the body and biassed in one direction, said stop member being formed with a lug projecting through a slot in the body and into a slot in the bush, the plunger being provided with means for engaging the stop member to slide it in the body against the bias, the slots in the body and in the bush each having a narrow section in which the lug locates when the stop member is in a first position in the direction in which it is biassed, the narrow section maintaining the body in said one rotational position relative to the bush and preventing relative rotation of body relative to the bush, one or both of the slots in the body and the bush having a wider section in which the lug locates when the stop member is in a second position in a direction against the bias, the wider section allowing relative rotation of the body relative to the bush, from said one position to said other rotational position.

In the preferred application in an electrical switch, switch contacts are closed in one position of the plunger in the body and open in the other position.

Until the plunger is depressed, in the preferred application by the brake pedal, the engagement of the lug in the narrow sections of the two slots prevents the body from turning in the bush. The switch cannot, therefore, be installed accidentally in a position in which the stoplamps would be permanently on.

In one convenient form, the stop member is generally cylindrical and slidable also on the plunger.

The slot in the bush may conveniently be of constant width over the distance the lug travels.

One embodiment of the invention will now be described with reference to the accompanying drawings, in which.

Figure 1:
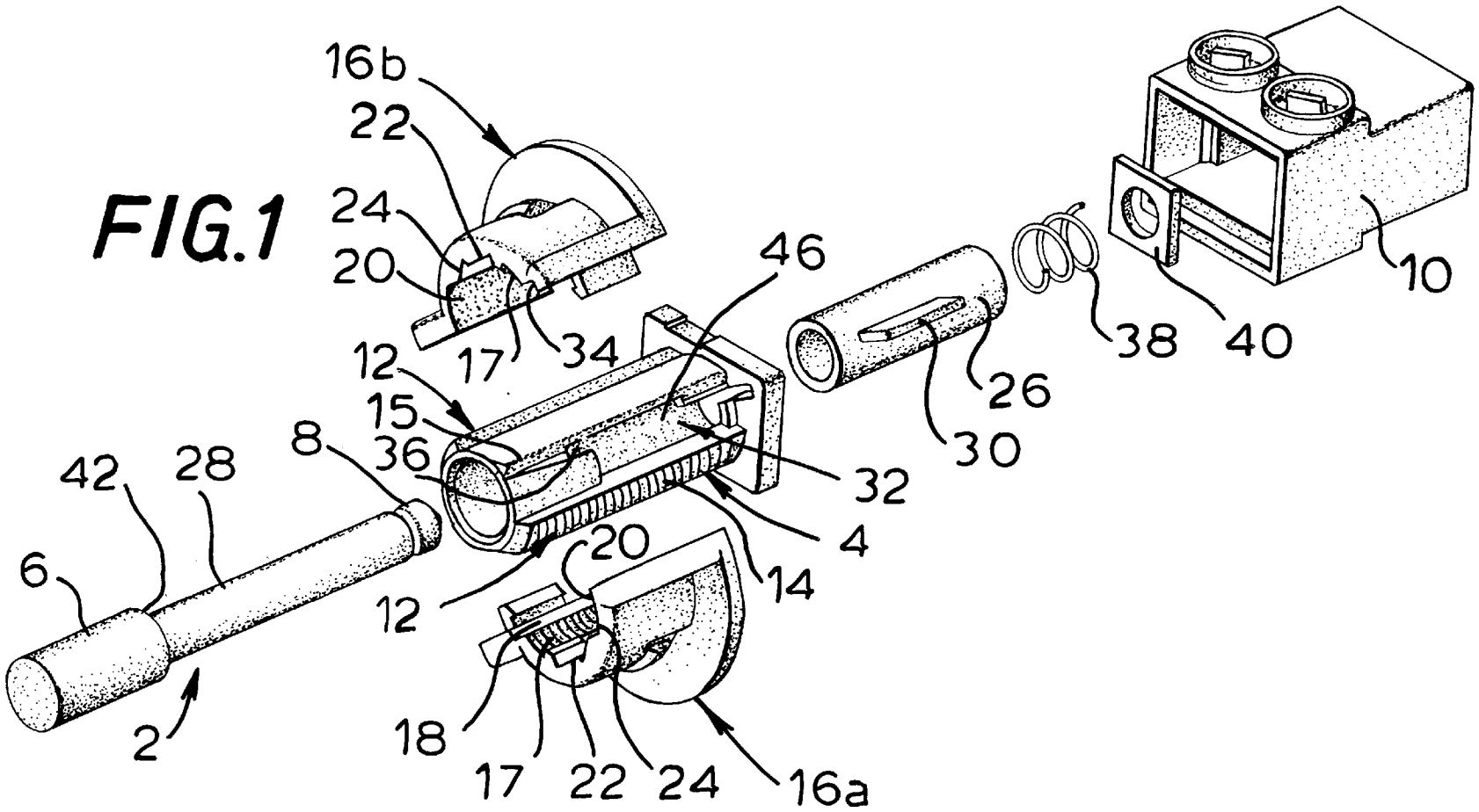
FIG. 1 is an exploded pictorial view of a plunger mechanism embodying the invention and applied to a stoplamp switch.
Figure 2:
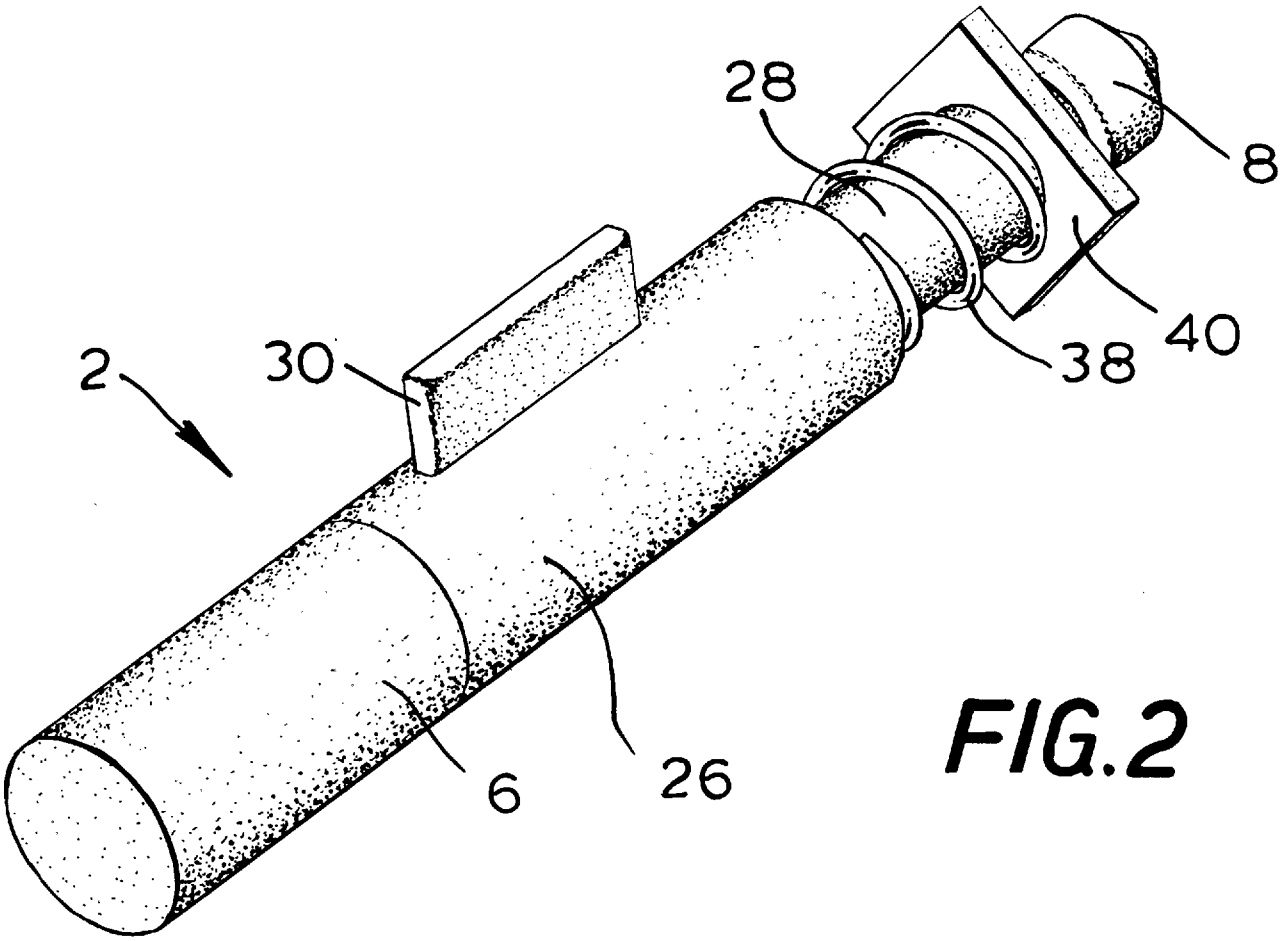
FIG. 2 is a pictorial view of the plunger of the stoplamp switch of FIG. 1, assembled with a stop member.
Figure 3:
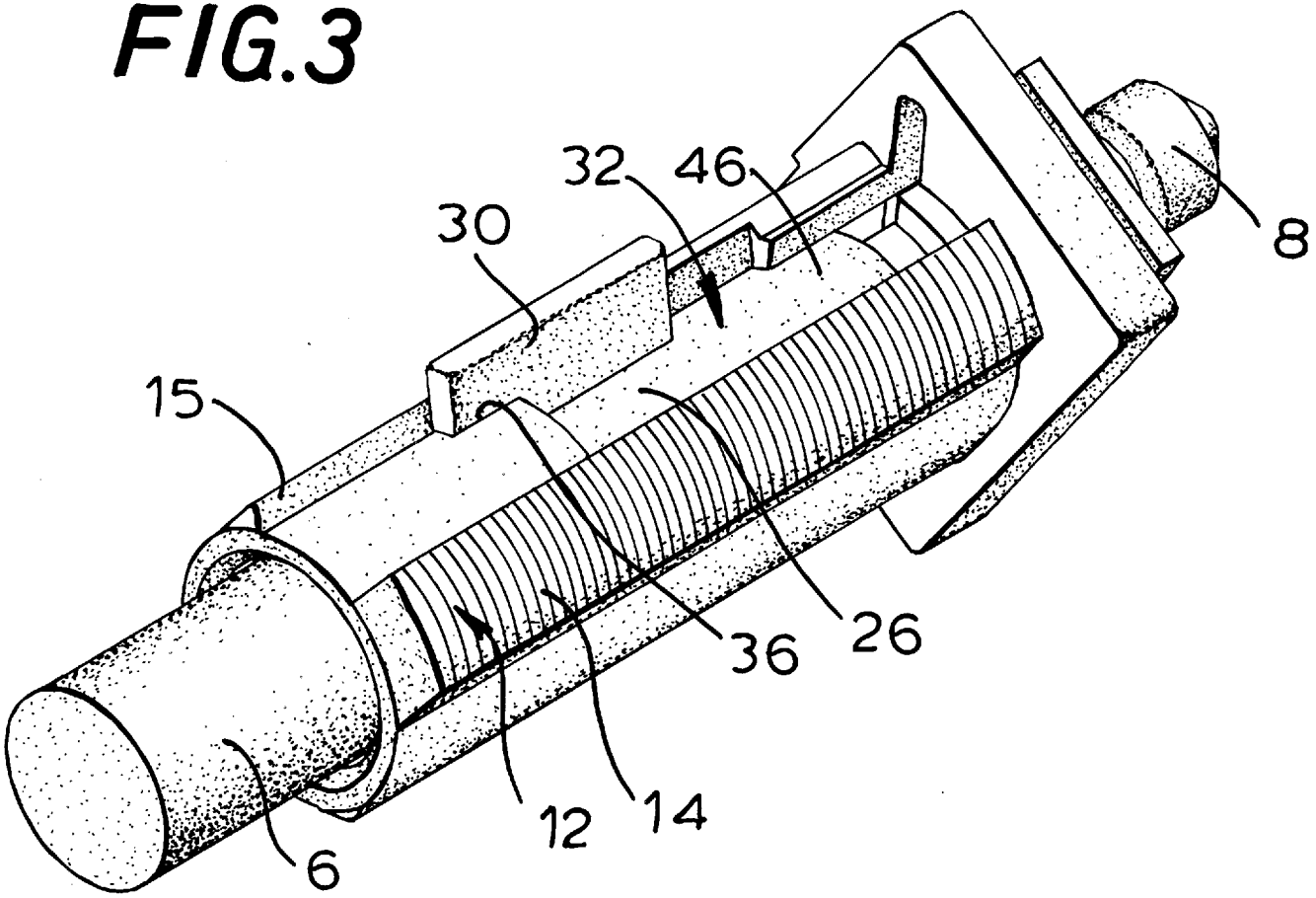
FIG. 3 is a pictorial view of assembly of FIG. 2 installed in the body of the stoplamp switch of FIG. 1, the plunger being extended.
Figure 4:
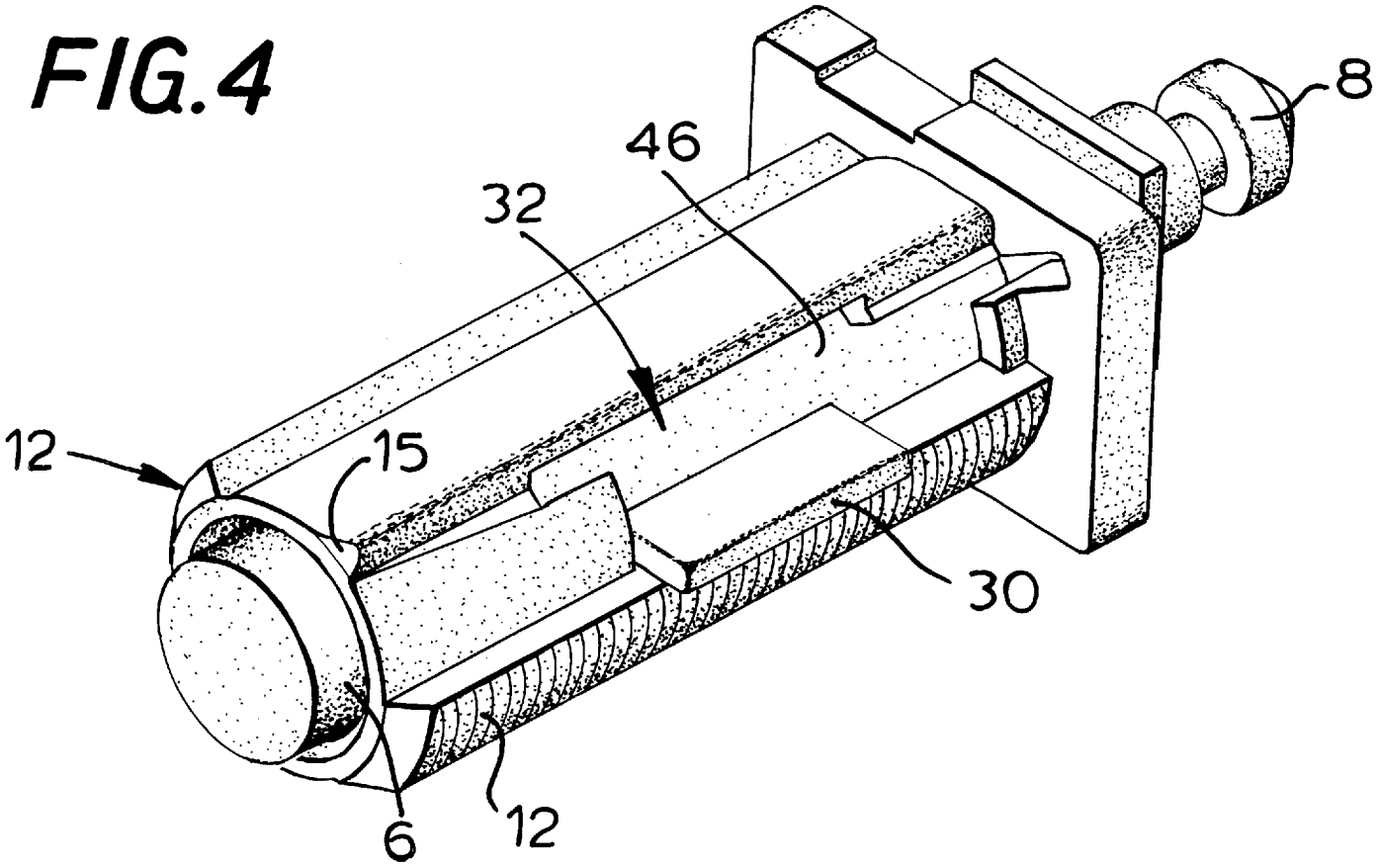
FIG. 4 is a similar view to that of FIG. 3 except that the plunger is shown depressed and the stop member rotated.
Figure 5:
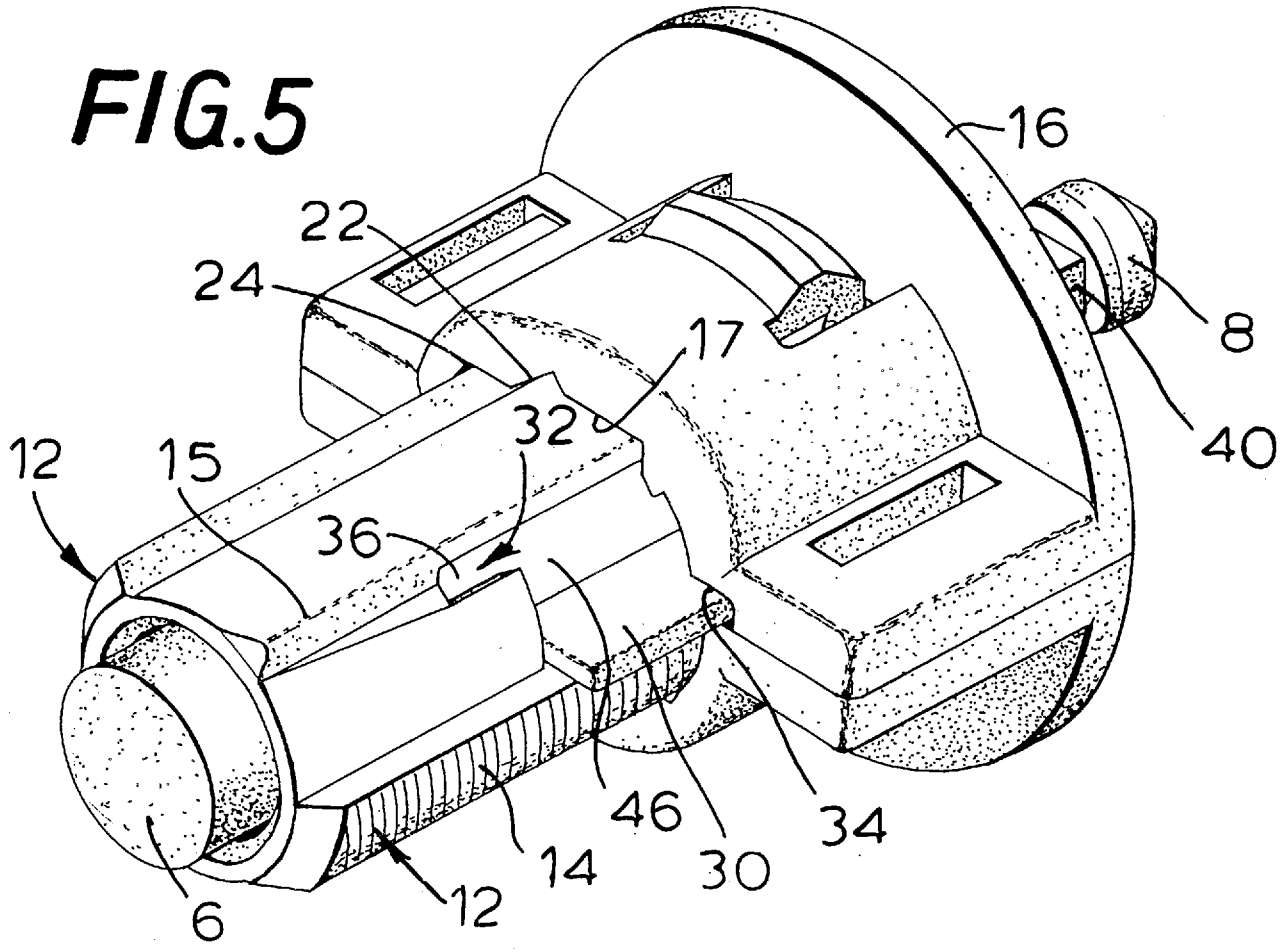
FIG. 5 is a pictorial view of the arrangement shown in FIG. 4 with the addition of the bush; and engaged with switch contacts not shown in FIG. 1 but contained within a housing shown therein.
Figure 6:
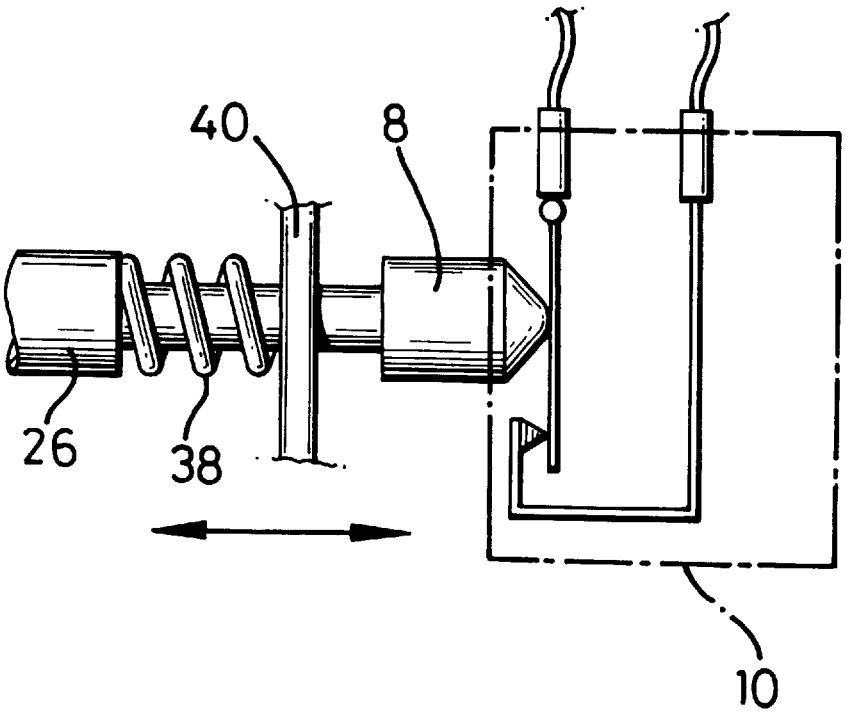

Referring to the drawings, a plunger 2 is slidably mounted in a generally cylindrical plastics body 4. The plunger is biased by a coil spring, not shown, to an extended position shown for example in FIG. 3, in which an end portion 6 extends from the body. The opposite end 8 of the plunger operates switch contacts, which are contained in a housing 10. The contacts are open when the plunger is depressed sufficiently into the body as illustrated in FIG. 4 and are closed in the position of the plunger shown in FIG. 3.

The body 4 is provided with two diametrically opposed longitudinal lands 12 on which is provided a screw thread 14. The body is also provided with two longitudinal wedges 15, only one of which is visible in the drawings. A plastics bush 16 is assembled from two halves 16*a* and 16*b*. The bush is formed with an aperture 18 having a shape corresponding to the cross section of the body 4. Thus the aperture is generally cylindrical with recesses 20 to accommodate the projecting screw threads 14 on the body, and recesses 22 to accommodate the wedges 15 on the body. Between recesses, the bush is provided with a screw thread 17 corresponding to the thread 14.

In use, the bush 16 is mounted in a bracket over the brake pedal, not shown. The body in inserted into the bush until the plunger is completely depressed by the brake pedal. Adjacent the recesses 22 the bush is formed with similar recesses 24. When the plunger is suitably depressed, the body is twisted in the bush so engaging screw thread 14 with the screw thread 17. The wedges 15 rotate with the body from recesses 22 to recesses 24 in the bush, thus indexing the body. Because of the orientation of the wedges, rotation in the reverse direction is resisted.

In order to ensure that the plunger is fully depressed before the body 4 is twisted, a stop member 26 is provided.

The stop member is slidable longitudinally on a section 28 of the plunger of reduced diameter, and within the body 4. A lug 30 extends through a slot 32 in the body into a slot 34 in the bush. The slot 34 in the bush is a sliding fit on the lug 30. Similarly, a section 36 of the slot in the body is a sliding fit on the lug 30. A spring 38 acts between the inner end of the stop member and a pad 40 secured in the housing 10 to bias the stop member in an outward direction. Before installation of the switch, the lug 30 is positioned in the section 36 and retained there by the action of the spring 38. With the lug in this position, the lug lines up with the slot 34 in the bush at the same time as the lands 12 and wedges 15 are aligned with the respective recesses 20 and 22 allowing the body to be slid into the bush. However, since the lug is a sliding fit in the slot 34 in the bush, it is not possible to rotate the lug around the axis of the plunger. Since the lug is a sliding fit in the section 36 of the slot 32, the body cannot be rotated relative to the lug or relative to the bush and thus cannot be locked.

If the body is pressed sufficiently into the bush that the plunger is depressed sufficiently into the body, opening the switch contacts, a shoulder 42 on the plunger engages an end of the stop member to urge it inwardly against the bias of the spring 38. Depression of the plunger by an amount sufficient to open the switch contacts, moves the lug 30 clear of the section 36 in the slot 32 and into a wider section 46 enabling the body to rotate relative to the lug 30 and thus the bush 16 so as to engage the threads 14 with the threads 17 securing the body in the bush.

In other embodiments, not illustrated, the stop member may be formed with more than one lug, e.g. two diametrically opposed lugs, or there may be two or more stop members each formed with one or more lugs. In the embodiment described above, the bush is formed from two identical halves, as illustrated, so in the assembled bush, there are two diametrically opposed slots 34.

We claim:

1. A plunger mechanism, comprising; a plunger; a generally cylindrical body having an axis, the plunger being slidable in the body between an extended position and a retracted position; and a bush for receiving the body for relative rotation about the axis, the body and the bush co-operating for allowing the body to slide in an axial direction when the body is in one rotational position relative to the bush and to be locked against sliding in an axial direction when the body is in another rotational position relative to the bush; a stop member slidable in the body and biassed in one direction, said stop member being formed with a lug projecting through a slot in the body and into a slot in the bush, the plunger engaging the stop member to slide the stop member in the body against the bias, the slots in the body and in the bush each having a relatively narrow section in both of which the lug locates when the stop member is in a first position in the direction in which the plunger is biassed, so maintaining the body in said one rotational position relative to the bush and preventing relative rotation of the body relative to the bush, one of the slots in the body and the bush having a relatively wide section in which the lug locates when the stop member is in a second position in a direction against the bias, so allowing relative rotation of the body relative to the bush, from said one position to said other rotational position.

2. A mechanism as claimed in claim 1, in which the stop member is generally cylindrical and slidable also on the plunger.

3. A mechanism as claimed in claim 1, wherein the slot in the bush is of constant width over the distance the lug travels.

4. An electrical switch incorporating a plunger mechanism as claimed in any preceding claim, including switch contacts which are closed in one position of the plunger in the body and open in the other position.

* * * * *